US008937407B2

(12) United States Patent
Byrne et al.

(10) Patent No.: US 8,937,407 B2
(45) Date of Patent: Jan. 20, 2015

(54) WORKSURFACE POWER TRANSFER

(76) Inventors: Norman R. Byrne, Ada, MI (US); Robert L. Knapp, Rockford, MI (US); Timothy Warwick, Sparta, MI (US)

( * ) Notice: Subject to any disclaimer, the term of this patent is extended or adjusted under 35 U.S.C. 154(b) by 1086 days.

(21) Appl. No.: 12/889,914

(22) Filed: Sep. 24, 2010

(65) Prior Publication Data

US 2011/0089768 A1 Apr. 21, 2011

Related U.S. Application Data

(60) Provisional application No. 61/245,514, filed on Sep. 24, 2009.

(51) Int. Cl.
*H01F 37/00* (2006.01)
*H01F 38/14* (2006.01)

(52) U.S. Cl.
CPC ..... *H01F 38/14* (2013.01)
USPC ..... 307/104; 320/108

(58) Field of Classification Search
USPC ..... 307/104; 320/108
See application file for complete search history.

(56) References Cited

U.S. PATENT DOCUMENTS

| | | | | |
|---|---|---|---|---|
| 5,171,159 | A | 12/1992 | Byrne | |
| 5,575,668 | A | 11/1996 | Timmerman | |
| 5,959,433 | A * | 9/1999 | Rohde | 320/108 |
| 6,028,267 | A | 2/2000 | Byrne | |
| 6,028,413 | A | 2/2000 | Brockmann | |
| 6,036,516 | A | 3/2000 | Byrne | |
| 6,290,518 | B1 | 9/2001 | Byrne | |
| 6,379,182 | B1 | 4/2002 | Byrne | |
| 6,436,299 | B1 | 8/2002 | Baarman | |
| 6,756,697 | B2 | 6/2004 | Mizutani | |
| 7,212,414 | B2 | 5/2007 | Baarman | |
| 7,233,222 | B2 | 6/2007 | Baarman | |
| 7,355,150 | B2 | 4/2008 | Baarman | |
| 7,465,178 | B2 | 12/2008 | Byrne | |
| 2003/0202317 | A1 * | 10/2003 | Jans | 361/683 |
| 2004/0150934 | A1 | 8/2004 | Baarman | |
| 2007/0182367 | A1 * | 8/2007 | Partovi | 320/108 |
| 2007/0279002 | A1 * | 12/2007 | Partovi | 320/115 |
| 2008/0001572 | A9 | 1/2008 | Baarman | |
| 2008/0079392 | A1 | 4/2008 | Baarman | |
| 2008/0166965 | A1 | 7/2008 | Greene | |
| 2009/0212638 | A1 * | 8/2009 | Johnson | 307/104 |
| 2009/0230777 | A1 * | 9/2009 | Baarman et al. | 307/104 |
| 2010/0038970 | A1 * | 2/2010 | Cook et al. | 307/104 |
| 2010/0290215 | A1 * | 11/2010 | Metcalf et al. | 362/127 |
| 2011/0062789 | A1 * | 3/2011 | Johnson et al. | 307/104 |

* cited by examiner

*Primary Examiner* — Jared Fureman
*Assistant Examiner* — Alfonso Perez Borroto
(74) *Attorney, Agent, or Firm* — Varnum, Riddering, Schmidt & Howlett LLP

(57) ABSTRACT

A power transfer system (100) is used with a primary table (102) and one or more secondary tables (170). Incoming power is supplied from a source outlet receptacle block (108) to raceway assemblies (120, 134) and an energy center (140) on the primary table (102). The raceway assemblies (120, 134) are connected to a primary winding circuit (136) having a primary winding (160). A secondary table (170) also includes raceway assemblies (120, 134) connected to a secondary winding circuit (176). When the tables (102, 170) are in close proximity, magnetic flux generated from current flowing through the primary winding (160) commonly flows through the secondary winding (186), thereby inductively generating power which can be applied to the raceway assemblies (120, 134) associated with the secondary table (170).

15 Claims, 3 Drawing Sheets

WORKSURFACE POWER TRANSFER

CROSS-REFERENCE TO RELATED APPLICATIONS

This application is based upon and claims priority of U.S. Provisional Patent Application Ser. No. 61/245,514 filed Sep. 24, 2009.

STATEMENT REGARDING FEDERALLY SPONSORED RESEARCH OR DEVELOPMENT

Not Applicable.

PARTIES TO A JOINT RESEARCH AGREEMENT

Not Applicable.

REFERENCE TO A SEQUENCE LISTING

Not Applicable.

BACKGROUND OF THE INVENTION

1. Field of the Invention

The invention relates to contactless power or energy transmission systems and, more particularly, to contactless power transfer systems for transmitting electrical power from one table, desk or the like to another in the absence of requiring direct physical contact or any type of physical electrical wires, bus bars or the like.

2. Background Art

Contactless energy transmission systems are known in the prior art for transferring electrical power or energy from one device to another, without requiring any type of mechanical or physical, electrical connections. Contactless power transfer systems can exhibit a number of advantages over what may be characterized as conventional systems using electrical wires, bus bars or the like for power transfer. For example, contactless power transfer systems (excluding extremely high voltage configurations such as those found with transformers associated with utility power companies) are generally safer. This is because there is relatively limited danger of sparks or electrical shocks in view of the isolation of the initial power supply. Also, components of contactless power transfer systems tend to exhibit longer life, because there are few electrical contacts or other physical interconnections which can become worn and lose conductivity paths.

One type of contactless power transfer system uses what could be characterized as magnetic induction for purposes of transferring energy. Magnetic induction (also referred to as electromagnetic induction) is the production of voltage across a conductor which is situated in a changing magnetic field, or a conductor moving through a stationary magnetic field. The electromotive force (EMF) produced around the closed path is proportional to the rate of change of the magnetic flux through any surface bounded by that path. In practice, this means that an electrical current will be induced in any closed circuit when the magnetic flux through a surface bounded by the conductor changes. This applies whether the field itself changes in strength, or the conductor has moved through the field. Electromagnetic induction underlies the operation of all generators, electric motors, transformers, induction motors, synchronous motors, solenoids and many other electrical devices.

In particular, magnetic induction or electromagnetic induction is used with power transfer systems employing transformers. A transformer can be characterized as a device which transfers electrical energy from one circuit to another through inductively coupled conductors (i.e. the transformer coils). A varying current in the first "primary" winding creates a varying magnetic flux in the transformer's core. This produces a varying magnetic field through the secondary winding. This varying magnetic field induces a varying electromagnetic force or voltage in the secondary winding. This effect is often referred to as mutual induction.

If a load is connected to the secondary winding, an electric current will flow in the secondary winding, and electrical energy will be transferred from the primary circuit through the transformer, to the load. In an ideal transformer, the induced voltage in the secondary winding is in proportion to the primary voltage, and is given by the ratio of the number of turns in the secondary winding to the number of turns in the primary winding. Accordingly, by appropriate selection of the turn ratios, transformers allow an alternating current voltage to be "stepped up" by making the number of turns in the secondary winding greater than the number of turns in the primary winding. Alternatively, the voltage can be stepped down by making the number of turns in the secondary winding less than the number of turns in the primary winding. In the vast majority of transformers, coils are wound around a ferromagnetic core, with air-core transformers being an exception.

Transformers can come in a range of sizes, from a thumb nail-sized coupling transformer hidden inside a stage microphone, to relatively large units weighing hundreds of tons used to interconnect portions of national power grids. Although differing in sizes, all of these transformers operate with the same basic principles, although size ranges are wide and varied. Transformers are still found in nearly all electronic devices designed for household voltage. Also, transformers are essential for high voltage power transmission, which make long distance transmission economically practical.

Ideal transformers would have no energy losses, and would therefore be 100% efficient. However, in practice, transformer energy is dissipated in windings, core and surrounding structures. These losses can exist with respect to winding resistance. That is, current flowing through the windings causes resistive heating of the conductors. At higher frequencies, skin effect and proximity effect create additional winding resistance and losses. Also, hysteresis losses can occur. Specifically, each time the magnetic field is reversed, a small amount of energy is lost due to hysteresis within the core. For any given core material, the loss is proportional to the frequency, and is a function of the peak flux density to which it is subjected.

Still further, eddy currents can cause power losses. Magnetic materials are good conductors, and a solid core made from such a material constitutes a single short circuited turn throughout its entire length. Eddy currents therefore circulate within the core in a plane normal to the flux, and are responsible for resistive heating of the core material. The eddy current loss is a complex function of the square of supply frequency and inverse square of the material thickness. Other losses which may exist with respect to transformers are typically referred to as magnetostriction, mechanical losses and stray losses. Stray losses can exist with respect to any leakage flux which intercepts nearby conductive materials, such as the transformer's support structure. Such flux interception will give rise to eddy currents, and will be converted to heat.

With contactless power transfer systems relevant to this application, power from a primary winding in the power supply is transferred inductively to a secondary winding located in another physical location. Because the secondary winding is physically spaced from the primary winding, the inductive coupling occurs through the air.

With respect to the use of power in commercial and industrial establishments, power is typically generated from an outside power line from a utility company. Commercial and industrial establishments may often have meeting rooms or the like where a number of different tables, desks or other worksurfaces may be utilized. It is advantageous in many settings for the tables and the like to provide users sitting or otherwise working at the tables to have close access to electrical power. For these reasons, it is known to have various types of power centers mounted on or within the various worksurfaces. Such power centers usable with worksurfaces are disclosed in: Timmerman, U.S. Pat. No. 5,575,668; Byrne, U.S. Pat. No. 6,028,267; and Byrne, U.S. Pat. No. 6,290,518. The power centers disclosed in these patents obtain electrical power from a physically separate source through the use of electrical cords and the like. That is, electrical power is provided to the power centers through the use of physical and electrical connections.

A disadvantage of requiring physical, electrical connections to power sources and power centers having electrical outlets and the like on the tables is made apparent when the tables need to be rearranged and moved on a regular basis, so as to accommodate different sizes and types of meetings. Currently, these tables have to be mechanically and electrically connected by means of mechanical connectors, and male and female plugs and sockets. Methods of electrically connecting together power centers on various tables is not only relatively complex, but is also very time consuming. Accordingly, it would be advantageous to have an improved method of providing power to a series of tables, where the tables might be required to be arranged in various configurations.

Further with respect to contactless power transfer systems, a number of different types of systems exist. For example, Baarman, et al., United States Publication No. US 2008/0001572 discloses a vehicle power interface having an adaptive inductive power supply. The power supply includes a primary winding with a remote device holder. The inductive power supply is capable of providing power to remote devices placed within the remote device holder. Communications interfaces can be provided which enable communication between the remote device and any data bus within the vehicle.

A device for charging batteries is disclosed in Brockmann, U.S. Pat. No. 6,028,413. The device includes a mobile electrical device in a charging unit. The electrical device and charging unit inductively transfer electrical power by means of alternating magnetic fields from at least one primary winding to at least one secondary winding in the mobile device.

Mizutani, et al., U.S. Pat. No. 6,756,697 discloses a mounting structure for mounting accessories on an interior member in a vehicle compartment. The structure includes mounting portions which have non-contact type power sending terminals and vehicle-side antennas. The mounting portions transmit power from the battery of the vehicle by means of the non-contact type power sending terminals, and also transmit multiplex signals which include control signals required for controlling a number of accessories associated with the vehicle.

Baarman, U.S. Pat. No. 7,212,414 discloses a contactless power supply having a dynamically configurable tank circuit which is powered by an inverter. The power supply can be inductively coupled for one or more loads, and the inverter can be connected to a DC power source. When loads are added or removed from the system, the contactless power supply is capable of modifying the resonant frequency of the tank circuit, the inverter frequency, the inverter duty cycle, or the rail voltage of the DC power source.

SUMMARY OF THE INVENTION

In accordance with the invention, a power transfer system is provided for distributing power throughout a spatial area. The spatial area includes at least two work units, with the work units including a first work unit and a second work unit. The power transfer system includes incoming means for receiving incoming power from a source of electrical power. First power distribution means are connected to the incoming means and secured to the first work unit, for selectively applying incoming power to first electrical devices to be energized. Second power distribution means are also provided, and are secured to the second work unit. The second power distribution means selectively applies power to second electrical devices to be energized. Inductive transfer means are connected to the first power distribution means and to the second power distribution means, for inductively transferring incoming power from the first power distribution means to the second power distribution means, when the first work unit is physically adjacent to the second work unit.

In accordance with other aspects of the invention, the second work unit can be made physically movable relative to the first work unit. Further, the spatial area can include a third work unit, in addition to the first and second work units. Each of the second and third work units are movable relative to each other, and relative to the first work unit.

In accordance with other aspects of the invention, the inductive transfer means includes at least a first primary inductive circuit and a first secondary inductive circuit. The first primary inductive circuit receives, directly or indirectly, the incoming power. The first primary inductive circuit can be located on the first work unit, with the first secondary inductive unit located on the second work unit. The incoming power can be inductively transferred when the first primary inductive circuit of the first work unit is positioned substantially adjacent the first secondary inductive circuit of the second work unit. The first secondary inductive circuit can be connected to the second power distribution means.

Still further, the inductive transfer means can include a second primary inductive circuit located on the second work unit, and connected to the second power distribution means. The first secondary inductive circuit is located at one end of the second work unit, and the second primary inductive circuit is located at an opposing end of the second work unit.

With the work units including at least first, second and third work units, the power transfer system can further include a second secondary inductive circuit associated with the third work unit. Third power distribution means can be located on the third work unit and connected to the second secondary circuit, for selectively applying power to third electrical devices to be energized. When the first secondary inductive circuit is moved substantially adjacent to the first primary inductive circuit, the incoming power can be inductively transferred to the second power distribution means through the first primary inductive circuit and the first secondary inductive circuit. When the second secondary circuit is moved substantially adjacent to the second primary inductive circuit, with the first secondary inductive circuit substantially adjacent to the first primary inductive circuit, the incoming power is inductively transferred to the third power distribution means through the second primary inductive circuit and the second secondary inductive circuit.

Still further, when the second secondary inductive circuit is moved substantially adjacent to the first primary inductive circuit, the incoming power is inductively transferred to the third power distribution means through an inductive coupling of the first primary inductive circuit and the second secondary inductive circuit. The power transfer system can include a series of first primary inductive circuits located on the first work unit, and a series of first secondary inductive circuits located on the second work unit.

In accordance with further aspects of the invention, the first work unit can include a work surface. The first power distribution means can include an energy center positioned above the work surface of the first work unit, with the energy center comprising electrical outlet receptacles. Also, the energy center can include data ports.

BRIEF DESCRIPTION OF THE SEVERAL VIEWS OF THE DRAWING

The invention will now be described with respect to the drawings, in which.

DETAILED DESCRIPTION OF THE INVENTION

Figure 1:
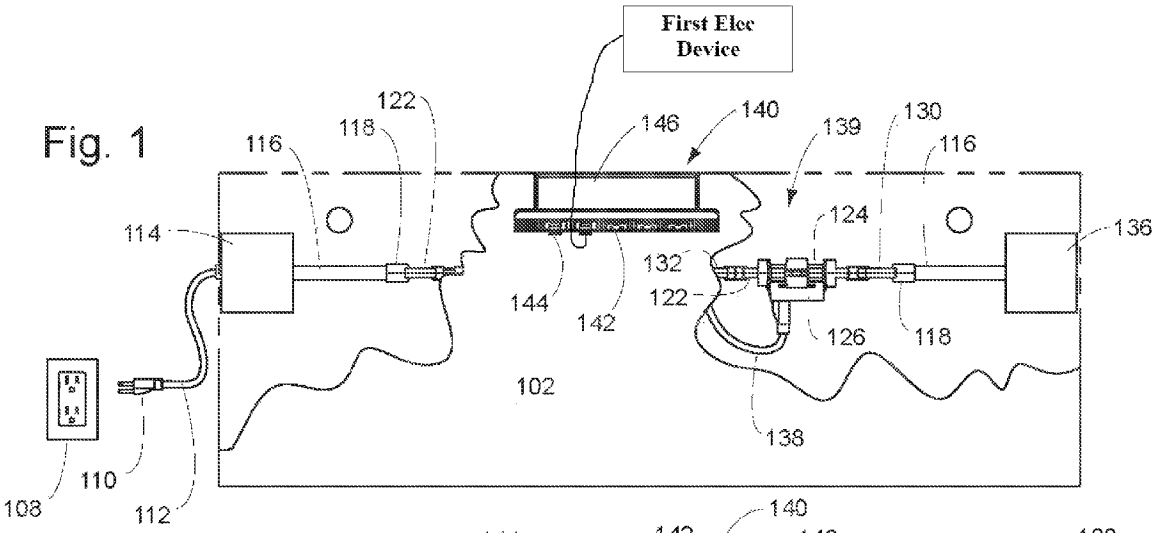
FIG. 1 is a front, elevation view of a primary table or first work unit having physical incoming means for receiving power from an incoming power source, the table further including electrical raceway assemblies, which can be characterized as a first power distribution means connected to the physical incoming means, and having a pair of junction blocks with outlet receptacle blocks and an energy center mounted above the table, in addition to a primary winding circuit (which can be characterized as a first primary inductive circuit) connected to the end of the raceway assembly which opposes the end of the assembly connected to the incoming power source.

The principles of the invention will now be disclosed, by way of example, in a power transfer system 100 associated with a series of tables or work units and illustrated in FIGS. 1-5. A primary concept of the power transfer system in accordance with the invention is the use of the same with a series of tables having raceway systems and power centers (which can be characterized as power distribution means) associated therewith. The tables include a primary table (or first work unit) to which external power is provided through standard power cords or cables. The primary table includes a primary winding circuit (which can be characterized as a first primary inductive circuit) in an opposing end of the table. When the primary table is moved adjacent a secondary table (or second work unit), a magnetic coupling will occur between the primary winding circuit on the primary table and a secondary winding circuit (which can be characterized as a first secondary inductive circuit) on the secondary table. Each of the secondary tables include not only a secondary winding circuit, but also a primary winding circuit (which can be characterized as a second primary inductive circuit). In this manner, power can be transferred not only initially from a primary table to a secondary table, but also then through a series of additional secondary tables (which can be characterized as a third work unit, fourth work unit, etc.). Still further, although not specifically shown in the drawings, the primary table and the secondary tables can include multiple winding circuits so that, for example, a number of secondary tables could be configured adjacent to one primary table and inductively receive power through a series of multiple primary winding circuits.

Figure 2:
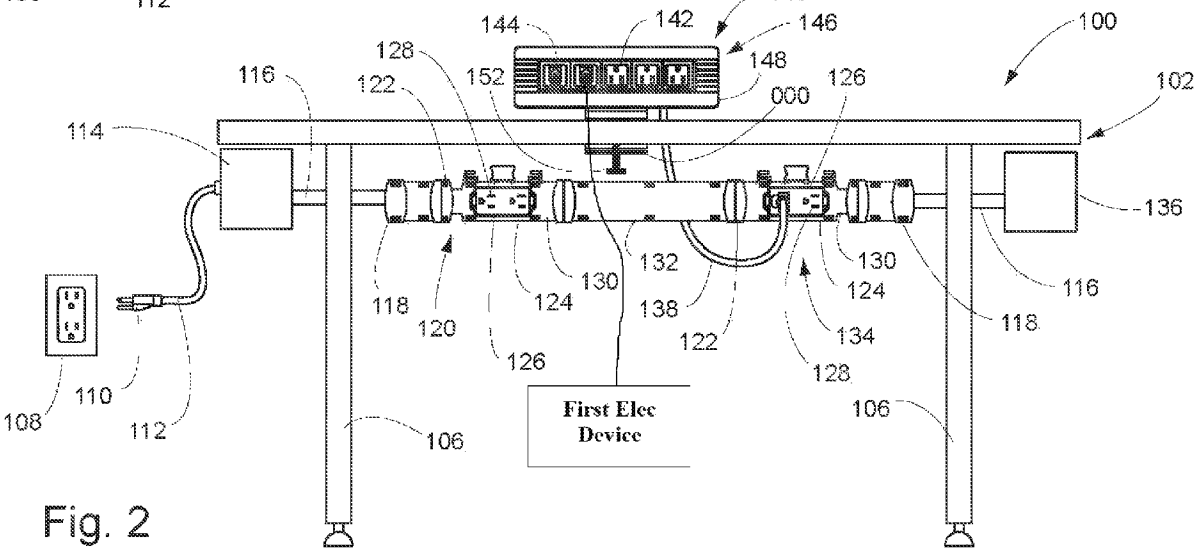
FIG. 2 is a plan view of the table shown in FIG. 1, with a portion of the upper surface (or work surface) of the table being in a cutout configuration so as to show various components of the electrical assemblies associated therewith.

Turning first to FIGS. 1 and 2 for the description of the power transfer system 100, the system 100 is adapted for use with a table or similar structure such as the primary table 102 illustrated in FIGS. 1 and 2. The primary table 102 can also be characterized as a first work unit 102, and can consist of any suitable working component. The primary table 102 includes a work surface 104 and legs 106. Adjacent the primary table 102 is a source outlet receptacle block 108. The source outlet receptacle block 108 acts as a source of external and incoming electrical power for use by the power transfer system 100. For energizing the power transfer system 100 from the receptacle block 108, a cord 112 and plug 110 are utilized. The cord 112 plugs into and is received by an incoming power circuit 114. The incoming power circuit 114 can be characterized as incoming means for receiving incoming power from the power source or outlet receptacle block 108. The incoming power circuit 114 can be relatively simplistic in structure, and can, for example, include a series of wires which extend through the outgoing power cable 116. For example, the system 100 could be utilized as a 3 wire, 5 wire, 7 wire or other system configuration. The power cable 116 includes a cable end connector 118. As primarily shown in FIG. 1, the cable end connector 118 is connected to an electrical raceway assembly 120 initially through an end connector 122 which connects directly into the cable end connector 118. The end connector 122 is coupled to a junction block 124. The junction block 124 includes a receptacle block 126 electrically and mechanically mounted therein. Outlet receptacles 128 extend outwardly from the receptacle block 126 and can be used to power various types of devices. Extending outwardly (i.e. to the right in FIG. 1) from the junction block 124 is a further end connector 130. The end connector 130 can electrically and mechanically connect to a center connector 132. The center connector 132 connects the first electrical raceway assembly 120 to a second electrical raceway assembly 134. This connection occurs from the right side of the cable connector 132 into another end connector 122. As shown primarily in FIG. 1, the second electrical raceway assembly 134 also includes a junction block 124 and receptacle block 126 with outlet receptacles 128. Extending to the right of the junction block 124 of the second electrical raceway assembly 134 is a further end connector 130. The end connector 130 connects to a cable end connector 118 of another power cable 116.

The electrical raceway assemblies 120, 134 and the associated circuitry described to this point do not form any significant novel concepts of the invention. Instead, electrical raceway assemblies corresponding to those described herein, and the means for electrically energizing the same from an external source of power are well known. For example, electrical raceway assemblies corresponding to those described herein and other raceway assemblies which may be utilized with the power transfer system 100 in accordance with the invention are disclosed in the following U.S. patents: Byrne, U.S. Pat. No. 5,171,159; Byrne, U.S. Pat. No. 6,036,516; and Byrne, U.S. Pat. No. 7,465,178. U.S. Pat. No. 7,465,178 is hereby incorporated by reference herein. The electrical raceway assemblies 120, 134 and the associated circuitry described herein can be characterized as being part of a first power distribution means. This first power distribution means can further be characterized as being connected to the incoming power means and secured to the first work unit or primary table 102.

The electrical wires from the power cable 116 extending to the right in FIG. 1 are connected to and received within what is characterized as primary winding circuit 136. Details of the primary winding circuit 136 will be described in subsequent paragraphs herein. Also in accordance with subsequent description herein, the primary winding circuit 136 can be characterized as a first primary inductive circuit.

The power transfer system 100 can also include certain electrical elements positioned above the worksurface 104. For example, and as primarily shown in FIGS. 1 and 2, an electrical cord 138 can be plugged into one of the outlet receptacles 128. The cord 138 can be utilized to energize what is characterized as an energy center 140 positioned above the worksurface 104. The energy center 140 provides a means for supplying electrical power to external devices through electrical outlet receptacles 142 which are energized through the electrical cord 138. If desired, the energy center 140 can also include data ports 144. The data ports 144 can be connected to various communication ports through communication lines (not shown) or the like. The particular external devices to be energized through the use of the energy center 140 can include any type of appropriate devices, such as computers, printers or other comparable devices. The devices are not shown in the drawings and do not form any of the principal novel concepts of the invention. The particular devices to be energized through the energy center 140 associated with the first primary table 102 can be characterized as first electrical devices, with the first power distribution means selectively applying incoming power to these first electrical devices. Correspondingly, electrical devices energized through power distribution means associated with a second table (to be described in subsequent paragraphs herein) can be characterized as second electrical devices. Also, devices energized through power distribution means associated with a third or subsequent table associated with a power transfer system can be characterized as third electrical devices, fourth electrical devices, etc. Also, the energy center 140 can be characterized as being part of the first power distribution means, in combination with the raceway assembly 120 and the second raceway assembly 134. Still further, the primary winding circuit 136, again as will be apparent from subsequent description herein, can be characterized as part of an inductive transfer means for inductively transferring incoming power from the first power distribution means.

The outlet receptacles 142 and data ports 144 are housed within an energy center upper housing 146. The energy center upper housing 146 is positioned within an outer shell 148. Extending below the outer shell 148 is a lower bracket 150. The lower bracket 150 can be utilized to secure the energy center 140 to an edge of the worksurface 104. A tightening screw 152 can extend through appropriate apertures within the lower bracket 150, and can be utilized to tighten portions of the lower bracket 150 to the worksurface 104. As with the electrical raceway assemblies 120, 134, the energy center 140 does not constitute any significant novel concepts of the invention. The concepts of an energy center 140 as described herein are known in the prior art. For example, such an energy center is disclosed in Byrne, U.S. Pat. No. 6,379,182. U.S. Pat. No. 6,379,182 is hereby incorporated by reference herein.

Figure 5:
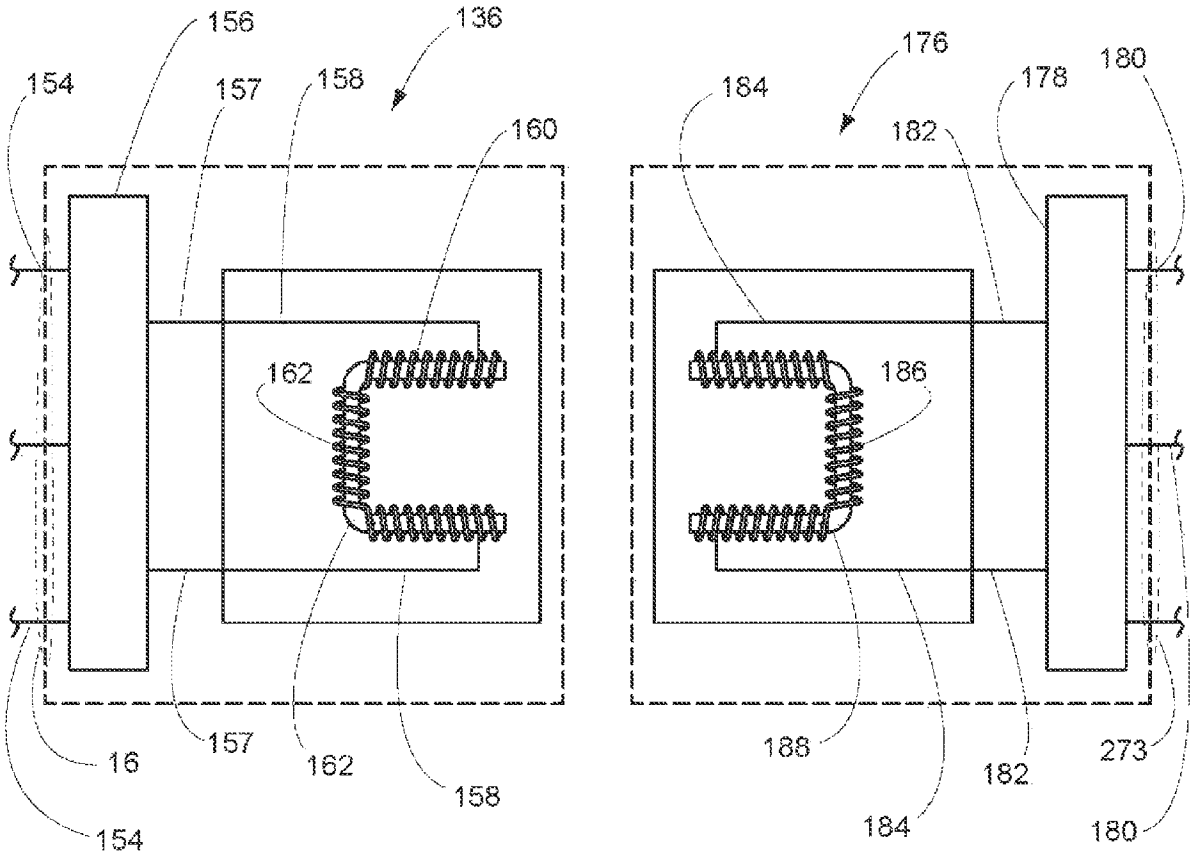
FIG. 5 is an enlarged view showing a primary winding of the primary winding circuit for one of the tables, and a secondary winding of a secondary winding circuit of one of the tables.

Returning to the elements of the power transfer system 100 in accordance with the invention, and as earlier described, electrical power is transferred through the electrical raceway assemblies 120, 134 associated with the primary table 102, with the power applied to the primary winding circuit 136. Reference is now made to FIG. 5, which shows certain elements of the primary winding circuit 136. As shown therein, the incoming power cable 116 can be characterized as, for example, a series of 3 wires or cables 154 which are received within what is characterized as a primary control circuit 156. The primary control circuit 156 includes appropriate circuitry so as to generate an AC current on output lines 157 which is of an appropriate amplitude and frequency for purposes of use as a power signal and for purposes of providing a power transfer through magnetic induction. The current on output lines 157 is applied to a coil wire 158. The coil wire 158 forms a primary winding 160, as particularly shown in FIG. 5. It should be noted that in FIG. 5, the primary winding 160 is actually shown as a series of three separate windings connected in series. However, the winding 160 can take many different forms, without departing from the novel concepts of the invention. For purposes of enhancing magnetic induction transfer, the primary winding 160 is secured around a ferrite core 162. With this circuitry, and with an AC current applied to the primary winding 160, magnetic flux voltages will be generated. As previously stated herein, the primary winding circuit 136 can also be characterized as a first primary inductive circuit, in that it is associated with the first table 102.

The concepts of generating a voltage through magnetic induction are generally well known. Also, appropriate circuitry for the primary control circuit 156 can take on many forms. For example, control circuitry associated with a primary winding for charging batteries in a mobile electrical device is illustrated and disclosed in Brockmann, U.S. Pat. No. 6,028,413. U.S. Pat. No. 6,028,413 is hereby incorporated by reference herein. Other control circuits which can be adapted for use as the primary control circuit 156 are disclosed in Baarman, U.S. Pat. No. 7,212,414 and Baarman, et al., U.S. Patent Application Publication US 2008/0001572.

Figure 3:
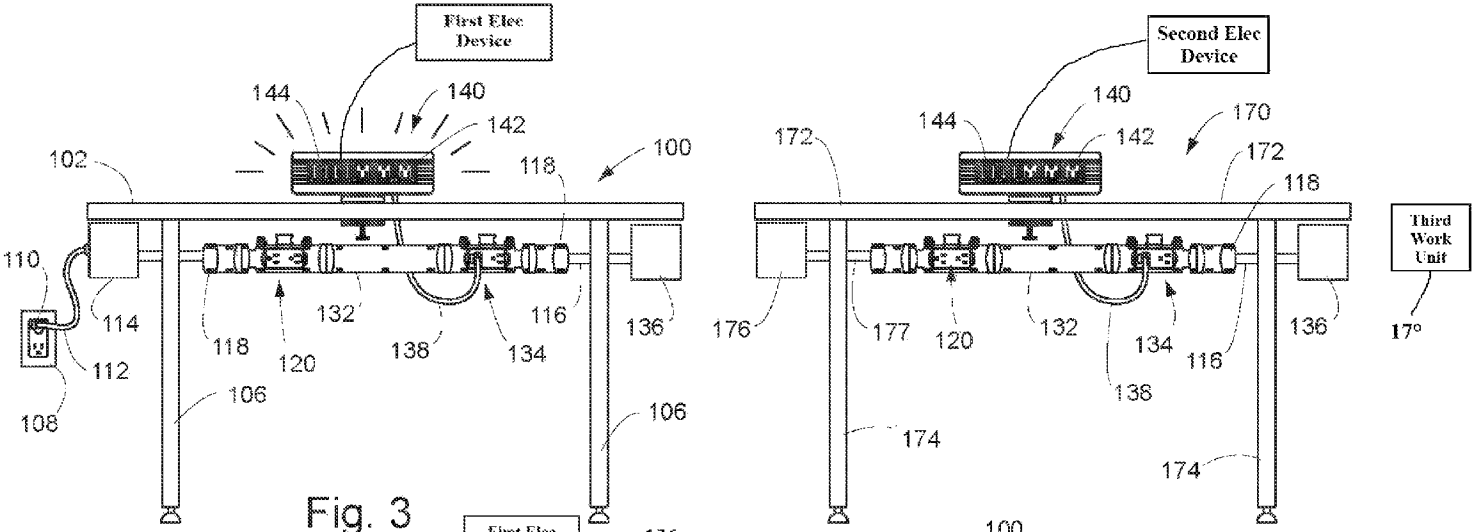
FIG. 3 is a front, elevation view of a pair of tables, which can be characterized as a first work unit and a second work unit, having circuitry in accordance with the invention, with one of the tables being equivalent to the table shown in FIG. 1, while the other table is a secondary table having a raceway assembly, which can be characterized as a second power distribution means, with a pair of junction blocks and electrical receptacle blocks, an upper energy center, a secondary winding circuit (which can be characterized as a first secondary inductive circuit) at a left side of the table and a primary winding circuit (which can be characterized as a second primary inductive circuit) at the right side of the table, and with the tables shown physically separated.
Figure 4:
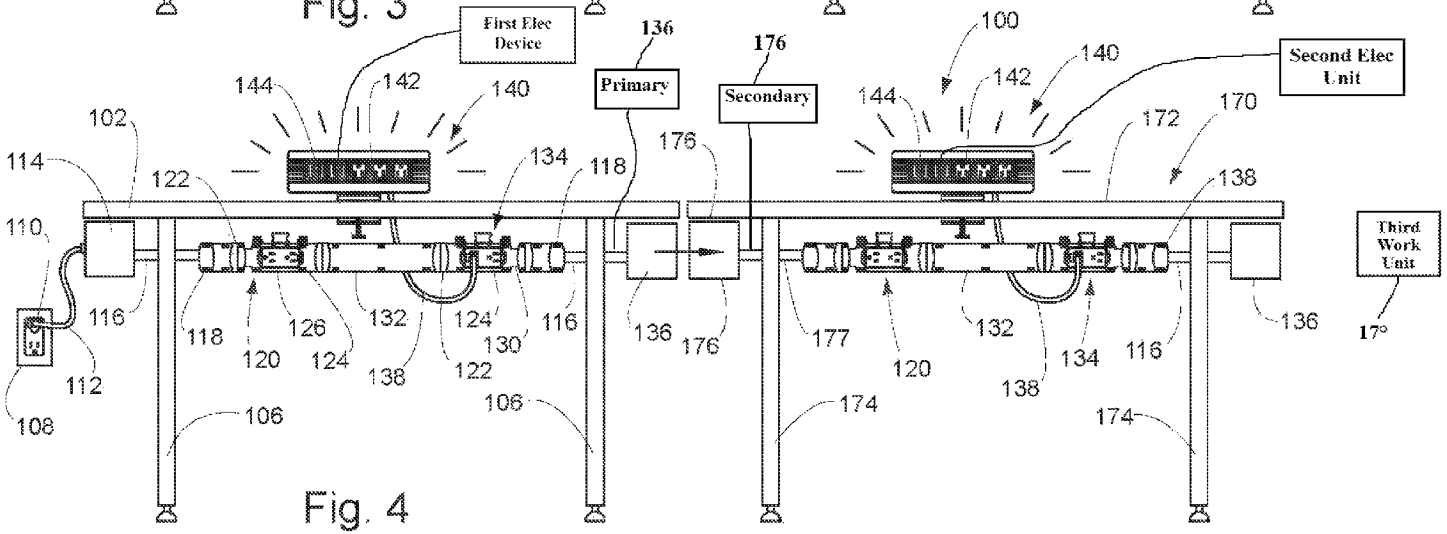
FIG. 4 is a front, elevation view of the table shown in FIG. 3, but with the tables moved sufficiently close in proximity so that power transfer can occur from one of the tables to the other one of the tables through magnetic induction (through magnetic flux generated by the first primary inductive circuit flowing through the first secondary inductive circuit)

As previously referred to herein, the power transfer system 100 can be adapted for use with one or more additional tables, which are identified herein as secondary tables 170. The secondary tables 170 can also be referred to as a second work unit, third work unit, fourth work unit, etc. A secondary table 170 is shown in FIGS. 3 and 4. With reference thereto, secondary table 170 also includes a worksurface 172 and legs 174. In addition, and as made apparent from FIGS. 3 and 4, the secondary table 170 also includes an electrical raceway assembly 120 and second electrical raceway assembly 134. Cabling interconnecting the raceway assemblies 120, 134 for the secondary table 170 correspond to the cabling associated with the same raceway assemblies used with the primary table 102. Accordingly, the description thereof will not be repeated. Still further, the secondary table 170 can also include an energy center 140, corresponding to the energy center 140 associated with the primary table 102. The raceway assemblies 120, 134, and the energy center 140 associated with the secondary table 170 can be characterized as a second power distribution means secured to a second work unit. This second power distribution means can further be characterized as selectively applying power to second electrical devices (not shown in the drawings) to be energized. Correspondingly, a third work unit or additional secondary table 170 can include electrical power means in the form of a third power distribution means for applying power to third electrical devices to be energized, although a specific third power distribution means and specific third electrical devices are not illustrated in the drawings.

In contrast to the primary table 102, the secondary table 170 includes what is characterized as a secondary winding circuit 176. The secondary winding circuit 176 is shown in FIGS. 3, 4 and 5. This secondary winding circuit 176 associated with the secondary table 170 can be characterized as a first secondary inductive circuit. With reference to FIG. 5, the secondary winding circuit 176 includes a secondary control circuit 178. The secondary control circuit 178 includes an output cable 177 having a series of wires or cables 180 extending outwardly therefrom. The wires or cables 180 associated with the cable 177 are shown in FIGS. 3 and 4 as connecting to the electrical raceway assembly 120. The wires or cables 180 will carry electrical power of appropriate amplitude and frequency so as to energize the electrical raceway assemblies 120, 134 and the energy center 140. Going in the opposite direction from the cables 180 associated with the secondary control circuit 178, the secondary control circuit 178 includes a pair of output wires 182. The output wires 182 are actually output wires associated with the output of the secondary winding 186. That is, the output wires 182 are connected to a coil wire 184. The coil wire 184 forms the secondary winding 186. As with the primary winding 160, the secondary winding 186 may actually consist of a series of windings, connected in series to each other. A ferrite core 188 is used with the secondary winding 186 to enhance magnetic induction.

When the primary table 102 is separated a sufficient physical distance from the secondary table 170, the primary winding 160 will be sufficiently separated from the secondary winding 186 so that there is no common magnetic flux flowing through the ferrite cores 162, 188. Accordingly, there would be no power transfer through magnetic induction from the primary winding 160 to the secondary winding 186. This configuration is shown in FIG. 3.

In contrast, when the primary table 102 and secondary table 170 are moved together so as to be appropriately adjacent (as shown in FIG. 4), the primary winding 160 and the secondary winding 186 are sufficiently close in proximity so that magnetic flux flowing through the ferrite core 162 as a result of electrical current flowing through the primary winding 160 will also flow through the ferrite core 188 associated with the secondary winding 186. This magnetic flux generated through magnetic induction will result in an electrical current flowing through the secondary winding 186, and a voltage existing across the output wires 182 (with appropriate resistive circuitry incorporated therewith). Accordingly, by moving the primary table 102 and secondary table 170 sufficiently close together, power is transferred from the primary table 102 to the secondary table 170. It should be noted that the secondary control circuit 178 can include circuit elements which are relatively well known in the art. For example, one type of secondary control circuit is disclosed in Brockmann, U.S. Pat. No. 6,028,413.

Further, it should be noted that the secondary table 170 not only includes the secondary winding circuit 176 at one end of the table, but also includes a primary winding circuit 136 located at the other end of the table. The primary winding circuit 176 associated with the secondary table 170 can also be characterized as a second primary inductive circuit. Accordingly, power can be transferred not only from the primary table 102 to a secondary table 170, but power can then further be transferred (through magnetic induction) to another secondary table 170. To accomplish this power transfer, the primary winding 160 of the primary winding circuit 136 associated with the first secondary table 170 will be moved in close proximity to the secondary winding 186 of the second secondary table 170. The second secondary table 170 can also be characterized as a third work unit. Further, the secondary winding 186 associated with the second secondary table 170 can also be characterized as a second secondary inductive circuit. This type of power transfer can continue through a series of additional secondary tables 170. In this regard, and as earlier stated, each of the additional secondary tables 170 can be characterized as a third work unit, fourth work unit, etc. Still further, the primary winding circuit 136 associated with the third work unit can be characterized as a third primary inductive circuit. Correspondingly, the secondary winding circuit 176 associated with the fourth work unit can be characterized as the third secondary inductive circuit. These references and number of work units and inductive circuits can continue as desired, subject to the power generation capabilities associated with the entirety of the circuitry, and the electrical codes which may exist with respect to limitations on power distribution. In addition, it is also possible to incorporate more than one primary winding circuit 136 with the primary table 102 or the secondary tables 170. Also, multiple secondary windings 186 can be incorporated within additional secondary tables 170. In this manner, secondary tables 170 can be grouped in various types of configurations relative to primary tables 102. Accordingly, a work unit can have its own primary inductive circuits which may be characterized as first, second, third, etc. primary inductive circuits. Correspondingly, work units can also have first, second, third, etc. secondary inductive circuits. Still further, these inductive circuits can be characterized as all being encompassed within the concept of inductive transfer means.

It should also be noted that for purposes of appropriate alignment of primary and secondary tables, various types of markings can be utilized with the tables, so as to indicate when the tables are in sufficiently close proximity for power transfer, and are properly aligned.

It will be apparent to those skilled in the pertinent arts that other embodiments of power transfer systems in accordance with the invention can be achieved. That is, the principles of power transfer systems in accordance with the invention are not limited to the specific embodiments described herein. It will be apparent to those skilled in the art that modifications and other variations of the above-described illustrative embodiment of the invention may be effected without departing from the spirit and scope of the novel concepts of the invention.

The invention claimed is:

1. A power transfer system for distributing power throughout a spacial area, said spacial area having at least two work units comprising a first work unit and a second work unit, said power transfer system comprising:

incoming means for receiving incoming power from a source of electrical power;

first power distribution means connected to said incoming means and secured to said first work unit, for selectively applying said incoming power to first electrical devices to be energized;

second power distribution means secured to said second work unit, for selectively applying power to second electrical devices to be energized; and inductive transfer means connected to said first power distribution means and to said second power distribution means, for inductively transferring said incoming power from said first power distribution means to said second power distribution means when said first work unit is physically adjacent to said second work unit.

2. A power transfer system in accordance with claim 1, characterized in that said second work unit is physically movable relative to said first work unit.

3. A power transfer system in accordance with claim 1, characterized in that said spacial area comprises a third work unit, in addition to said first and second work units, and each of said second and third work units are movable relative to each other, and relative to said first work unit.

4. A power transfer system in accordance with claim 1, characterized in that said inductive transfer means comprises at least a first primary inductive circuit and a first secondary inductive circuit.

5. A power transfer system in accordance with claim 4, characterized in that said first primary inductive circuit receives, directly or indirectly, said incoming power.

6. A power transfer system in accordance with claim 5, characterized in that:

said first primary inductive circuit is located on said first work unit; and said first secondary inductive circuit is located on said second work unit.

7. A power transfer system in accordance with claim 6, characterized in that said incoming power is inductively transferred when said first primary inductive circuit of said first work unit is positioned substantially adjacent said first secondary inductive circuit of said second work unit.

8. A power transfer system in accordance with claim 7, characterized in that said first secondary inductive circuit is connected to said second power distribution means.

9. A power distribution system in accordance with claim 8, characterized in that said inductive transfer means further comprises a second primary inductive circuit located on said second work unit and connected to said second power distribution means.

10. A power transfer system in accordance with claim 9, characterized in that said first secondary inductive circuit is located at one end of said second work unit, and said second primary inductive circuit is located at an opposing end of said second work unit.

11. A power transfer system for distributing power to a plurality of work units comprising at least first, second and third work units, said power transfer system comprising:

incoming means for receiving incoming power from a source of electrical power;

first power distribution means connected to said incoming means for selectively applying said incoming power to first electrical devices to be energized, said first power distribution means being associated with said first work unit;

a first primary inductive circuit connected to said first power distribution means;

a first secondary inductive circuit located on said second work unit;

second power distribution means connected to said first secondary inductive circuit, for selectively applying power received through said first secondary inductive circuit to second electrical devices to be energized;

a second primary inductive circuit connected to said second power distribution means;

a second secondary inductive circuit associated with said third work unit;

third power distribution means located on said third work unit and connected to said second secondary inductive circuit, for selectively applying power to third electrical devices to be energized;

when said first secondary inductive circuit is moved substantially adjacent to said first primary integrated circuit, said incoming power is inductively transferred to said second power distribution means through said first primary inductive circuit and said first secondary inductive circuit; and when said second secondary inductive circuit is moved substantially adjacent to said second primary inductive circuit, with said first secondary inductive circuit substantially adjacent to said first primary inductive circuit, said incoming power is inductively transferred to said third power distribution means through said second primary inductive circuit and said second secondary inductive circuit.

12. A power distribution system in accordance with claim 11, characterized in that when said second secondary inductive circuit is moved substantially adjacent to said first primary inductive circuit, said incoming power is inductively transferred to said third power distribution means through an inductive coupling of said first primary inductive circuit and said second secondary inductive circuit.

13. A power transfer system in accordance with claim 11, characterized in that said power transfer system comprises a plurality of first primary inductive circuits located on said first work unit, and a plurality of first secondary inductive circuits located on said second work unit.

14. A power transfer system in accordance with claim 11, characterized in that:

said first work unit comprises a work surface; and said first power distribution means comprises an energy center positioned above said work surface of said first work unit, with said energy center comprising electrical outlet receptacles.

15. A power transfer system in accordance with claim 14, characterized in that said energy center further comprises data ports.

* * * * *